US008894513B2

(12) United States Patent
Arroyo

(10) Patent No.: US 8,894,513 B2
(45) Date of Patent: Nov. 25, 2014

(54) OVERHAND THROWING TRAINING SYSTEM AND METHOD

(71) Applicant: Fernando Arroyo, Vero Beach, FL (US)

(72) Inventor: Fernando Arroyo, Vero Beach, FL (US)

( * ) Notice: Subject to any disclaimer, the term of this patent is extended or adjusted under 35 U.S.C. 154(b) by 101 days.

(21) Appl. No.: 13/632,387

(22) Filed: Oct. 1, 2012

(65) Prior Publication Data

US 2014/0094325 A1 Apr. 3, 2014

(51) Int. Cl.
*A63B 69/00* (2006.01)
*A63B 63/00* (2006.01)

(52) U.S. Cl.
CPC ..... *A63B 69/0002* (2013.01); *A63B 63/007* (2013.01); *A63B 63/00* (2013.01); *A63B 2069/0006* (2013.01); *A63B 69/00* (2013.01)
USPC ..... 473/454; 473/422; 473/451

(58) Field of Classification Search
CPC ..... A63B 69/0002; A63B 2069/0006; A63B 63/00; A63B 69/00; A63B 63/007
USPC ..... 473/422, 451, 454, 456, 446, 436, 455
See application file for complete search history.

(56) References Cited

U.S. PATENT DOCUMENTS

| | | | | |
|---|---|---|---|---|
| 1,537,738 | A | 5/1925 | Bisbing | |
| D139,807 | S | 12/1944 | Pease | |
| 3,552,749 | A | 1/1971 | Piggotte | |
| 4,286,779 | A | 9/1981 | Collins | |
| 4,781,376 | A | 11/1988 | Barnes, Sr. | |
| 5,342,267 | A * | 8/1994 | Adams et al. | 482/83 |
| 5,553,847 | A * | 9/1996 | Surrency | 473/453 |
| 5,639,243 | A * | 6/1997 | Ryan et al. | 473/451 |
| 6,402,641 | B1 * | 6/2002 | Lee | 473/446 |
| 6,896,630 | B1 * | 5/2005 | Breining | 473/422 |
| 6,899,646 | B2 * | 5/2005 | Conradi | 473/454 |
| 7,134,977 | B2 | 11/2006 | Campbell et al. | |
| 7,651,417 | B1 * | 1/2010 | Sims | 473/454 |
| D612,002 | S | 3/2010 | Richard | |
| 7,794,339 | B2 | 9/2010 | Bailey | |
| 7,901,305 | B2 * | 3/2011 | Maeda | 473/436 |
| D658,242 | S | 4/2012 | McDonald | |
| 8,277,340 | B1 | 10/2012 | Devine | |
| 8,529,382 | B2 * | 9/2013 | Green et al. | 473/454 |
| 8,668,604 | B2 * | 3/2014 | Stemle | 473/456 |
| 2003/0228943 | A1 * | 12/2003 | Powell | 473/454 |
| 2004/0053711 | A1 * | 3/2004 | Conradi | 473/454 |
| 2008/0312011 | A1 * | 12/2008 | Edmondson | 473/456 |
| 2011/0003653 | A1 * | 1/2011 | Stemle | 473/456 |

* cited by examiner

*Primary Examiner* — Mitra Aryanpour
(74) *Attorney, Agent, or Firm* — Morriss O'Bryant Compagni

(57) ABSTRACT

Systems and methods for training and improving overhand throwing. A first embodiment of a system includes at least one upper arm that extends from a central body. A pathway marked by indicia extends down the upper arm curving to indicate the correct motion for a desired overhand throw. A flexible slap card may be located along the pathway for use in a first training exercise. The body may include a hole for positioned and sized for use as a target for a second training exercise. Support structures for maintaining the system in a desired position may be included. Methods for training with overhand throwing exercises using the systems are also included.

19 Claims, 4 Drawing Sheets

OVERHAND THROWING TRAINING SYSTEM AND METHOD

TECHNICAL FIELD

The present invention relates to systems and methods for athletic training and more particularly to training an individual to perform an overhand throwing motion in a correct manner.

BACKGROUND

Many sports require a player to throw a ball using an overhand motion, whether pitching a baseball, passing a football, or returning a caught softball to another player. Known training systems and devices typically are directed to only a single type of overhand throw. For example, devices on which a user stands while practicing an arm throwing motion that align or move the feet in a desired fashion for throwing from a pitchers mound are known. Further, such devices typically only support a single exercise by a user.

A system that is capable of being used to practice proper technique for multiple types of overhand throws would be an improvement in the art. Such a system that supports multiple exercises and is easily portable for use would be a further improvement in the art.

SUMMARY

A system for training and improving overhand throwing. At least one upper arm extends from a central body. A pathway marked by indicia extends down the upper arm curving to indicate the correct motion for a desired overhand throw. A flexible slap card may be located along the pathway for use in a first training exercise. The body may include a hole for positioned and sized for use as a target for a second training exercise. Support structures for maintaining the system in a desired position may be included.

For use in a first exercise, a user places the system within reach and stands before it in a throwing position. The user may then perform the motions of an overhand throw, with the feet, legs and rest of the body placed in the proper position for the type of throw. As the user moves their throwing arm through the motions, the user tracks the pathway marked on the system with the throwing hand to maintain the proper motions and position throughout the throw. Contact is made by the user with the slap card to provide feedback on a correct throw.

For use in a second exercise, a user places the system at a desired distance and stands before it in a throwing position. An overhand throw is actually performed and the user utilizes the pathway marked on the system for tracking the motion and uses the hole in the system body as a target for placement of the released ball.

DESCRIPTION OF THE DRAWINGS

It will be appreciated by those of ordinary skill in the art that the various drawings are for illustrative purposes only. The nature of the present invention, as well as other embodiments of the present invention, may be more clearly understood by reference to the following detailed description, to the appended claims, and to the several drawings.

DETAILED DESCRIPTION

It will be appreciated by those skilled in the art that the embodiments herein described, while illustrative of certain teachings, are not intended to so limit the invention or the scope of the appended claims. Those skilled in the art will also understand that various combinations or modifications of the embodiments presented herein can be made without departing from the scope of the invention. All such alternate embodiments are within the scope of the present invention.

Figure 1:
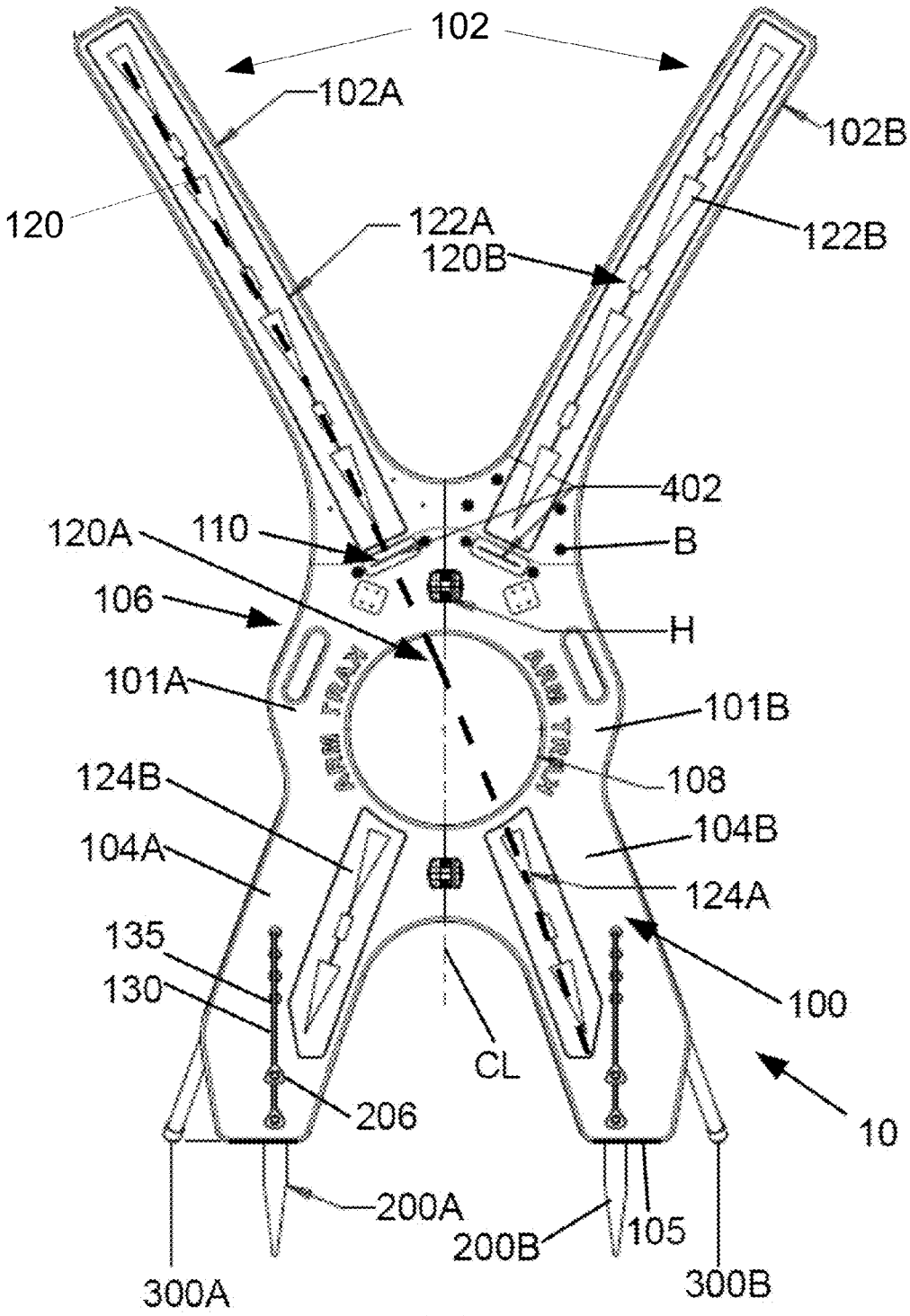
FIG. 1 is front view of a first system in accordance with the principles of the present invention.

Referring to FIG. 1, a first illustrative embodiment of a system 10 is depicted. A body 100 may be formed of two generally symmetrical portions 101A and 101B that align along a central line CL. As depicted, the portions 101A and 101B may be hingedly connected to one another with hinges H to allow the system 10 to fold at central line CL, to fold into a smaller form for storage purposes.

Each portion 101A or 101B may include a central portion that joins together at central line CL to form a central section 106 of body 100. A target opening 108 may be formed through the central portion 106 and may be centered on center line CL. The target opening 108 may be sized to allow the passage of a desired ball therethough for use in a throwing exercise discussed further below.

At least one upper arm 102 extends upwards at an angle from central body 106. In the depicted embodiment, two upper arms 102A and 102B extend from the central body 106, one on each of the right and left sides of the central body 106. The arms 102A and 102B may be removable for storage or transportation, allowing the overall height of system 10 to be reduced. For example, where the system 10 is sized with a height of about six feet, removing the arms 102A and 102B allows the system 10 to fit in a package that can be easily transported in the trunk of an automobile. The arms may be removed and attached by manipulating bolts B which may have a tool receiving head or be formed as thumbscrews. It will be appreciated that other suitable structures to facilitate the alignment and attachment of the arms may be included, such as receiving slots in the central body 106 into which the arms 102 are inserted prior to securing or attachment plates for ensuring a proper alignment between the faces of the various components of system 10.

It will be appreciated that where arms 102A and 102B are not removed, that upon folding along center line CL, the arms 102A and 102B may lie adjacent one another in a common line for convenient storage.

Similarly, lower legs 104A and 104B may extend downwards at an angle from the central body 106, one on each of the right and left sides of the central body 106. Upon folding along center line CL, the legs 104A and 104B may lie adjacent one another in a common line for convenient storage. It will be appreciated that in other embodiments, the central body may extend to the bottom of the system 10 rather than have individual legs. Rubber or plastic pads 105 may be disposed on the bottom surface of legs 104 to minimize slipping of the system 10 when is used on a relatively slick surface, such as a wood or tile gym floor.

As depicted, each upper arm 102 may have a slight curve with respect to a pathway along its long axis from the central body 106. In other embodiments, the arm may extend in a straight line at a desired angle from the body 106. A pathway 120A or 120B which is marked by indicia 122A or 122B extends down the upper arm 102A or 102B and curving to indicate the correct motion for a desired overhand throw.

Each pathway 120 extends across the target opening 108 and continues on the opposite side of the system 10. Indicia 124A or 124B may be used to mark such portion of the respective pathway 120A and 120B. In the depicted embodiment, the pathways continue down the opposite legs 124B and 124A.

It will be appreciated that the indicia 122 or 124 may be formed and disposed on the system 10 as may be desired for a particular usage. For example, the indicia may be a sticker or a series of stickers that are adhered to the front surface of the system 10, or a paint or dye applied thereto. In other embodiments, the indicia may be formed or embossed directly into the front surface.

In order to provide tactile feedback to a user, a flexible slap card 402 may be included in the system 10. As depicted in FIG. 1, a slot 110 may be disposed through body 100 at a location along a pathway 120. In the depicted embodiment, there are two slots 110, each associated with one of the two pathways 120A and 120B.

Figure 3:
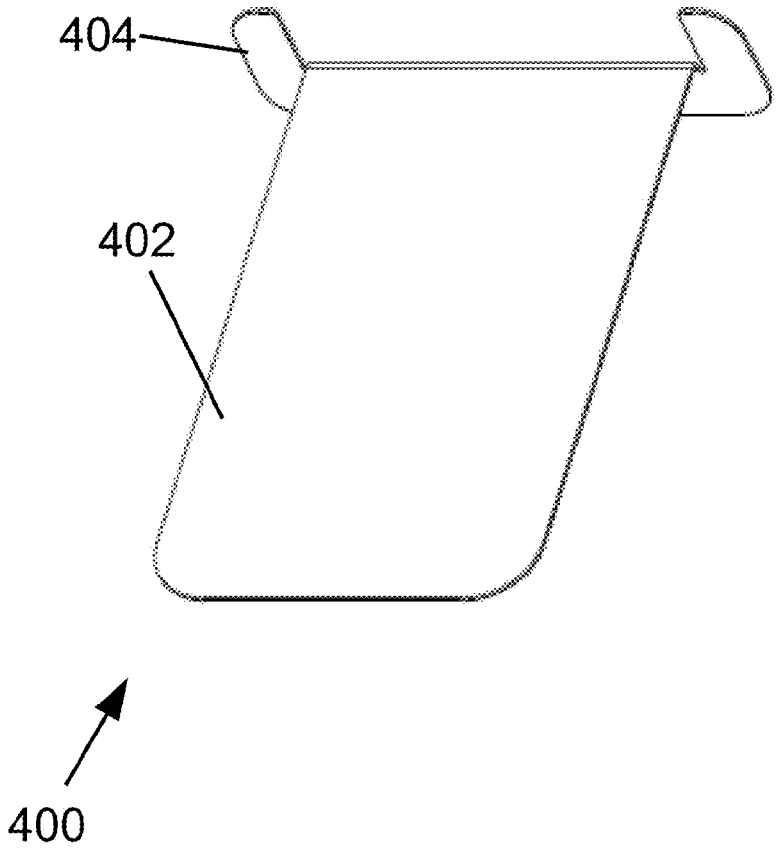
FIG. 3 is a perspective view of a slap card assembly for use with the embodiment of FIGS. 1 and 2.

As best depicted in FIG. 3, a slap card assembly 400 may include a generally planar base 404 from which a generally planar card portion 402 extends in a generally orthogonal direction. In some embodiments, at least card portion 402 may be formed from a material that can be deformed from the generally orthogonal position by deflection upon striking, and then return to the starting position. For example, the card portion 402 may be formed from a plastic or a rubber material having suitable deflection qualities. In such embodiment, the entirety of the slap card assembly 400 may be formed as an integrated unit of injection molded plastic. In alternative embodiments, the card portion 402 may be formed of a stiffer material and attached to the base portion 404 by flexible hinge.

The card portion 402 of card assembly 400 may be inserted through slot 110 such that the base portion 404 lies adjacent the back surface of the system 10 or in a recess formed on the back surface of system 10. As depicted, the slap card portion 402 is disposed along a pathway 120 with the planar surface of the card generally orthogonal to a centerline of the curved pathway 120. As depicted, the card assembly 400 and slot 110 may be disposed near the junction of central body 106 and an upper arm 102. It will be appreciated that the system 10 may include multiple slots 110 at various positions for insertion of the slap car assemblies 400. Where the slots 110 are disposed at different vertical heights along the pathway 120, this can allow the system 10 to be used by various users having different heights as will be discussed below.

Figure 2:
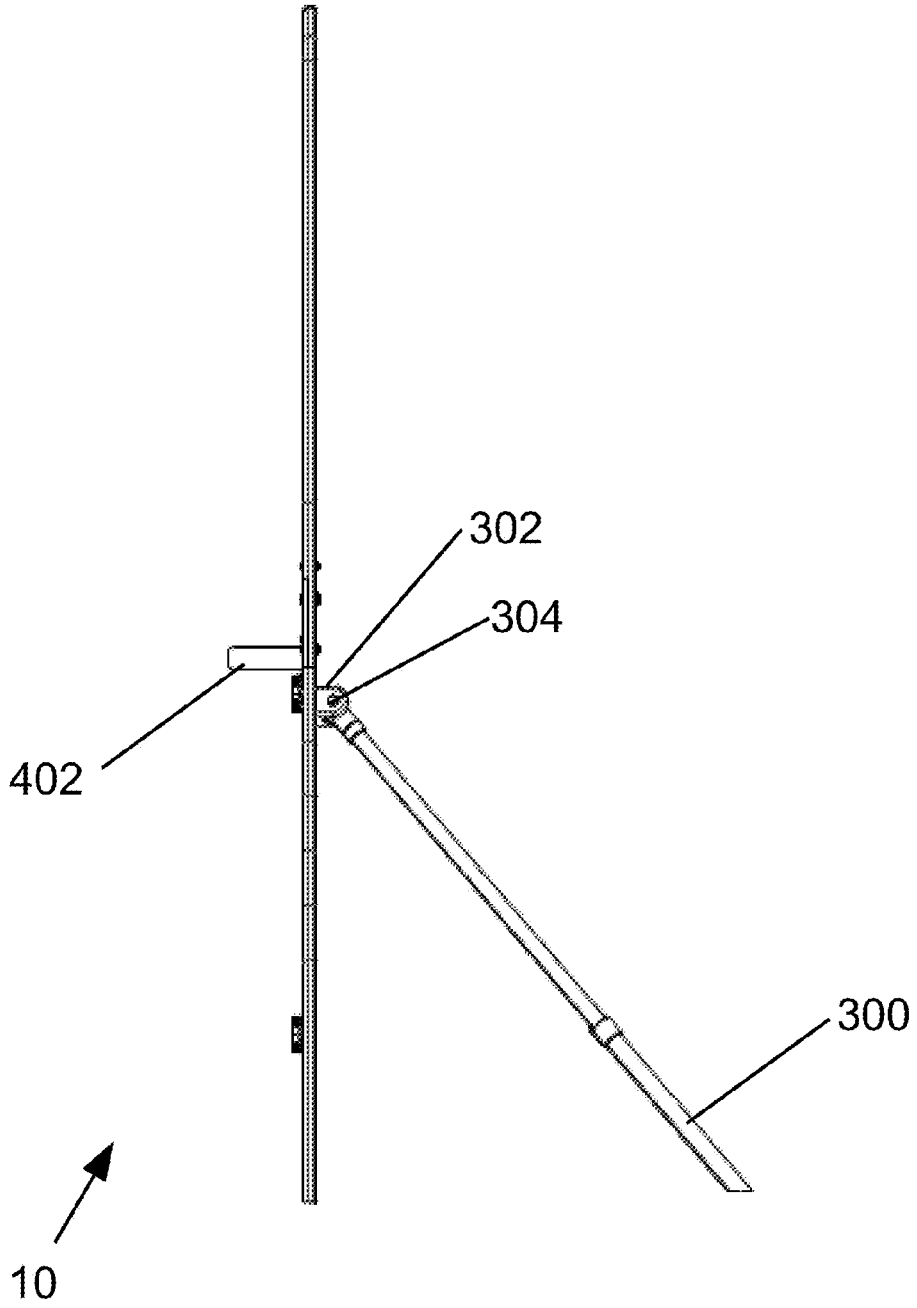
FIG. 2 is a side view of the embodiment of FIG. 1.

As best depicted in FIG. 2, a support leg 300 may be hingedly attached to the rear surface of each of the central sections 101A and 101B. In the depicted embodiment, this attachment is made through a hinge 302 including a hinge pin 304 around which the leg 300 can pivot to a deployed position. Each support leg 300A and 300B may be rotated to a deployed position with a distal end thereof placed against the ground or other surface on which the system 10 is deployed, to support the system 10 in a standing position. It will be appreciated that the support legs 300 may be adjustable in length, as by a tube within a tube construction for use on uneven ground.

Figure 4A:
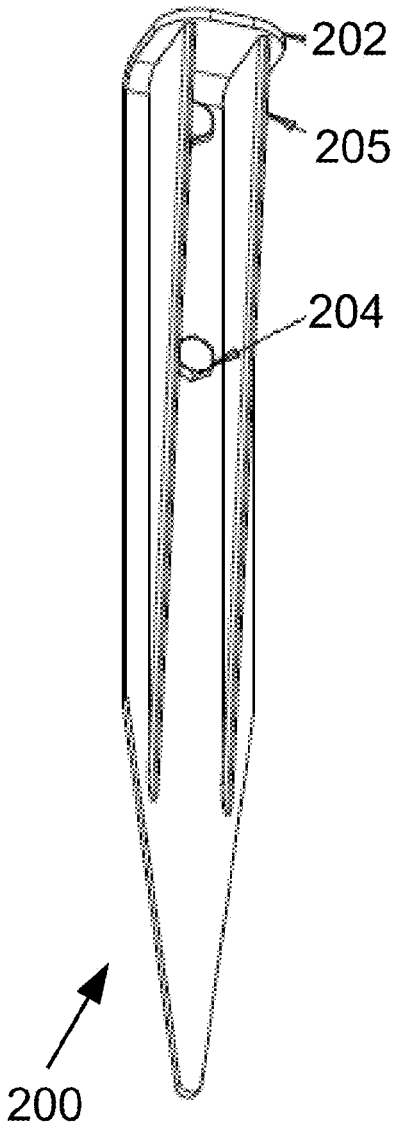
FIGS. 4A and 4B are perspective and side views of a ground spike for use with the embodiment of FIGS. 1 and 2.
Figure 4B:
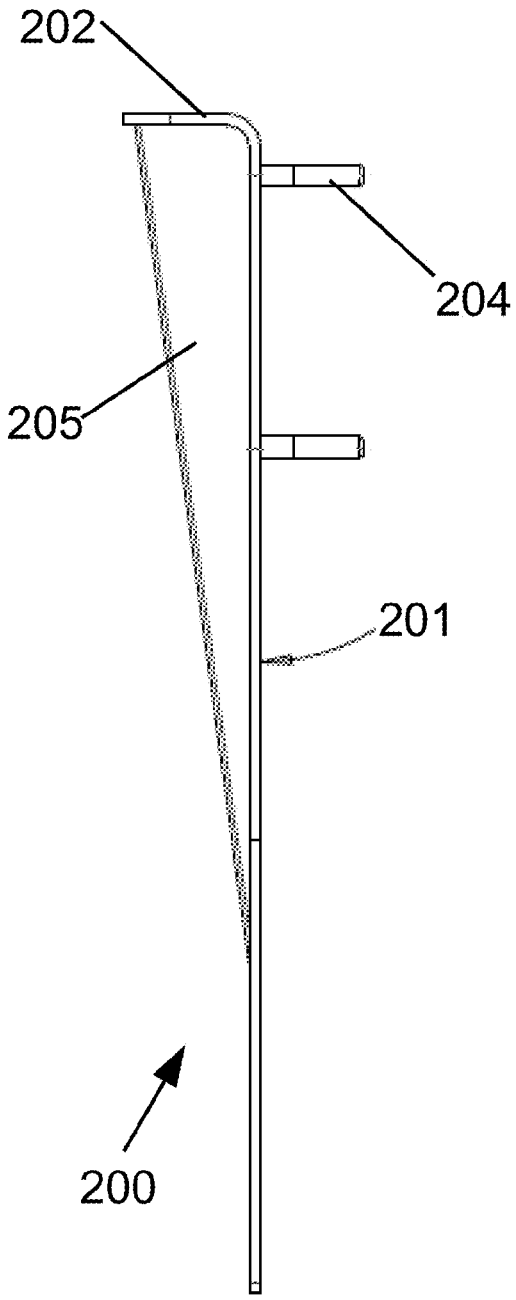

In addition to the support legs 300A and 300B, the system may include two retractable ground spikes 200A and 200B for securing the system 10 to the ground when used in an outdoor setting. In the depicted embodiment, the two ground spikes 200A and 200B are associated with each of the legs 104A and 104B. The structure of each spike 200 is best depicted in FIGS. 4A and 4B. As shown, each spike 200 may include a generally planar top 202 with an extended lip to serve as a handle for pushing the spike 200 into the ground and retracting it therefrom. The spike 200 extends from the top 202 to a pointed distal tip and may have a flat front surface 201. Braces 205 may extend from underneath the top 202 to the body of the spike 200 for additional support.

Each of legs 104 may include a spike slot 130 to allow for slidable attachment of the spike 200 to the leg 104. As depicted, each spike 200 may have one or more bolts 204 inserted therethrough, which are secured within the spike slot 130 by a retaining gasket or nut 206. Where desirable, a sleeve or gasket may be placed over the bolt 204 to facilitate movement in the slot 130. As depicted, the use of two or more blots 204 may be used to maintain proper alignment between the spike 200 and the system 10. Enlarged portions or stops 135 may be present in the slot 130 to allow for the retaining of the spike 300 at a desired level.

A system 10 may be set up for use by unfolding the two generally symmetrical portions 101A and 101B by rotating on hinges H to form common central portion 106. Depending on where the system 10 is to be used, the support legs 300 and/or spike 200 may be deployed to support and secure the system 10.

In a first type of exercise for improving an overhand throw, a system in accordance with the principles of the present invention may be used in a manner similar to the following, which is a "dry work" or "shadow work" exercise. At least one slap card assembly 400 is placed in the appropriate slot 110 for a right hand or left hand throw, depending on the user, with the card portion 402 extending out past the front surface of the system 10. The user stands before the system 10 in a throwing position with the slap card portion 402 within reach. In an embodiment, where the system 10 is sized for a little league pitcher, the user may stand from about three to about four feet from the system.

The user may then perform the motions of an overhand throw, with the feet, legs and rest of the body placed in the proper position for the type of throw, typically moving the user's throwing hand downwards from an upper position on the throwing hand side of the body above the body downwards at an angle to a release position. As the user moves their throwing arm through the motions, the user tracks the pathway 120 marked on the system 10 with the throwing hand to maintain the proper motion and positions throughout the practice throw. As the user moves the throwing hand downwards from an upper position on the upper arm 102 facing the same side of the user's body along the pathway 120 towards the leg 104 on the opposite side, the user's hand will "slap" or make contact with the slap card portion 402 of the slap card assembly 400. The slap card portion 402 may be deflected downwards and then returned to a generally orthogonal position. The tactile feedback from contact with the slap card 402 and an audible sound made by the slap may indicate to the user that the proper motion was used.

For this first type of exercise, the user may make the motion with an empty hand, moving the user's hand by "breaking" the wrist as if releasing a ball in order to slap the slap card 402. By repeating this exercise, the user develops muscle memory of the correct motions for a proper overhand throw, which persists in actual play and improves the user's ability. Since the pathway 120 remains generally the same for overhand throws in a variety of games, the system 10 may be used by users training to play a number of different games, including baseball, softball, football, etc. Where the positions of the user's feet, or the correct grip for the ball vary based on the game that the user is training for, these can vary as needed.

Additionally, where the proper release point varies for the particular game, the position of the slap card may vary. For example, a user training to throw a football in an overhand throw with a spiral release may stand differently than a user training for a baseball throw. Additionally, the position of the hand when it contacts the slap card 402 may vary based on the type of throw.

Similarly, it will be appreciated that the slap card 400 may be placed at the appropriate point along the pathway to mimic the release of the ball by the user. For a user training to throw baseball pitches which travel downwards from a pitcher's mound towards home plate, the release point may be relatively lower, closer to the user's knees. For a user training to throw a football or another ball which travels upwards from the user, a higher position for the slap card 400 and the simulated release may be used.

Systems in accordance with the present invention may be offered in various sizes to correspond to the size of the individuals that may use it for training purposes. For example, a user performing the first type of exercise may be a child of various age, or an adult of either sex. For example, children playing little league baseball, or peewee football, high school or college athletes playing baseball, football or softball or adults playing softball or baseball, or individuals of any age playing other sports involving overhand throwing.

For use in a second type of exercise, a user may position themselves at an appropriate distance from the system 10. For example, where the user is training to pitch a baseball or throw a softball, the user may face the system 10 at a distance equal to the distance between the pitching mound and the home plate for the game and the player's skill level (peewee ball, little league age group, etc). The user stands before the system 10 in a throwing position and performs an overhand throw utilizing the appropriate pathway 120 marked on the system for tracking the motion of the throw and using target hole 108 as a target for placement of the released ball.

The target hole 108 may be positioned to facilitate training for the particular sport of interest to a user. For example, where intended for baseball or softball, systems 10 may be sized for users of different ages with the target holes 108 positioned to lie in the average strike zone for players in that demographic. Additionally, system 10 may have the target hole 108 may be sized in increments of the ball with which the system is intended to be used (such as 1.25×, 1.5×, 2.0×, 3.0×, etc. the diameter of the ball) to allow for accuracy training at various skill levels. In some embodiments, the size of target hole 108 may be adjustable.

For use in another type of exercise, a system 10 may be positioned at a point between two users who face each other at a distance. For example, the system 10 may be set up and the users face each other across the system 10 each positioned about 45 feet away from the system to create a total distance of about 90 feet, similar to the distance between first and second base on a standard baseball field. The system 10 may have the pathways 120 marked on both the front and rear faces of the system 10 such that the pathways 120 are visible to each user.

The users then throw the ball to one another while using the appropriate pathway 120 marked on the system 10 to track the motion of the throw. In one variation of this type of exercise, the users start at a first distance from the system 10 and gradually move away from the system 10 to lengthen the distance of the throws.

While this invention has been described in certain embodiments, the present invention can be further modified with the spirit and scope of this disclosure. This application is therefore intended to cover any variations, uses, or adaptations of the invention using its general principles. Further, this application is intended to cover such departures from the present disclosure as come within known or customary practices in the art to which this invention pertains and which fall within the limits of the appended claims.

What is claimed is:

1. A system for training and improving a user's overhand throwing, comprising:

a body which comprises at least a first upper arm raising from a lower portion of the body adjacent a first side thereof and a first lower leg extending downwards from a lower portion of the body adjacent a second side thereof opposite the first side;

at least a first pathway indicated on the body by indicia which indicates a course the user's throwing hand should follow when correctly performing an overhand throw, the at least first pathway extending from an upper portion of the at least first pathway disposed on the at least first upper arm near the first side of the body to a lower portion of the at least first pathway disposed on the first lower leg near the second side of the body; and at least a first slap card assembly disposed on the body such that the slap card is a flexible member disposed along the at least first pathway.

2. A system for training and improving a user's overhand throwing, comprising:

a body;

at least a first pathway indicated on the body by indicia which indicates a course a user's throwing hand should follow when correctly performing an overhand throw;

at least a first slap card assembly disposed on the body such that the slap card is a flexible member disposed along the at least first pathway; and a target hole disposed through the body, sized for passage of a ball therethrough.

3. The system of claim 1, wherein the body further comprises a second upper arm raising from a lower portion of the body adjacent a second side thereof opposite the first side with an upper portion of a second pathway indicated by a second set of indicia which indicates a course a user's throwing hand should follow when correctly performing an overhand throw.

4. The system of claim 3, wherein the body is formed of two symmetrically opposite sections which fold along a center line which defies a vertical axis of a front face of the body.

5. The system of claim 1, wherein the at least first slap card assembly comprises a flexible planar member defining the slap card attached to a generally orthogonal base and is disposed along the at least first pathway by insertion of the slap card through a slot from a rear surface of the body.

6. The system of claim 1, further comprising at least a first support leg attached to a rear surface of the body with a hinge, said at least first support leg extending from a proximal end to a distal end for supporting the system in an upright position.

7. The system of claim 6, wherein the at least first support leg is adjustable in length.

8. The system of claim 6, further comprising a second support leg attached to a rear surface of the system with a hinge and extending from a proximal end to a distal end for supporting the system in an upright position.

9. The system of claim 6, further comprising at least a first ground spike slidably attached near a lower end of the at least one support leg, the at least first ground spike comprising a stake having a tapered distal end for insertion into the ground to secure the system in an upright position.

10. The system of claim 9, wherein the at least first ground spike is slidably attached by insertion of at least a first bolt passing therethrough and through a vertical slot in the leg, such that the at least first bolt can move vertically in the vertical slot.

11. The system of claim 1, wherein the at least first pathway indicated on the body comprises indentations formed in the front surface of the body.

12. A system for training and improving a user's overhand throwing, comprising:

a body which comprises at least a first upper arm extending from a lower portion of the body adjacent a first side thereof and a first lower leg extending downwards from a lower portion of the body adjacent a second side thereof opposite the first side; and at least a first pathway indicated on the body by indicia which indicates a course the user's throwing hand should follow when correctly performing an overhand throw while facing the body, the at least first pathway indicia extending along a length of the at least first upper arm and along a length of the at least first lower leg.

13. The system of claim 12, wherein the body further comprises a second upper arm extending from a lower portion of the body adjacent the second side of the body and a second lower leg extending downwards from a lower portion of the body adjacent the first side of the body; and a second pathway indicated on the body by indicia which indicates a course the user's throwing hand should follow when correctly performing an overhand throw while facing the body, the second pathway indicia extending along a length of the second upper arm and along a length of the at second lower leg.

14. The system of claim 13, wherein the body is formed of two symmetrically opposite sections which fold along a center line which defies a vertical axis of a front face of the body.

15. The system of claim 12, wherein the at least first pathway indicated on the body comprises indentations formed in the front surface of the body.

16. The system of claim 12, further comprising at least a first support leg attached to a rear surface of the body with a hinge, said at least first support leg extending from a proximal end to a distal end for supporting the system in an upright position.

17. The system of claim 16, wherein the at least first support leg is adjustable in length.

18. The system of claim 12, further comprising at least a first ground spike slidably attached near a lower end of the at least one support leg, the at least first ground spike comprising a stake having a tapered distal end for insertion into the ground to secure the system in an upright position.

19. The system of claim 18, wherein the at least first ground spike is slidably attached by insertion of at least a first bolt passing therethrough and through a vertical slot in the leg, such that the at least first bolt can move vertically in the vertical slot.

* * * * *